United States Patent [19]

Gabel et al.

[11] 4,384,711

[45] May 24, 1983

[54] CARD FEEDING APPARATUS FOR AN AUTOMATIC EMBOSSING SYSTEM

[75] Inventors: Edward R. Gabel, Eden Prairie; Glenn H. Heiller, Minnetonka, both of Minn.

[73] Assignee: Data Card Corporation, Minnetonka, Minn.

[21] Appl. No.: 198,597

[22] Filed: Oct. 20, 1980

[51] Int. Cl.[3] ..... B65H 1/08

[52] U.S. Cl. ..... 271/129; 400/130

[58] Field of Search ..... 271/129, 138, 128, 130; 400/130

[56] References Cited

U.S. PATENT DOCUMENTS 1,058,868 4/1913 Kepple ..... 271/138

1,153,325 9/1915 McDade ..... 271/129

3,323,628 6/1967 Gollwitzer ..... 400/130

*Primary Examiner*—Richard A. Schacher

*Attorney, Agent, or Firm*—Staas & Halsey

[57] ABSTRACT

An apparatus for feeding cards to an embossing apparatus in an automatic embossing system includes an adjustable input hopper and a card picking mechanism. The input hopper can be adjusted to receive cards of varying height, width and thickness. The card picking mechanism includes a card shelf for supporting a card substantially along the length of its bottom edge, a carriage upon which the card shelf is mounted and a cam and rocker arm drive arrangement for reciprocating the card shelf and carriage. The card feeding apparatus provides a large feeding force and is particularly suitable for feeding metal cards.

10 Claims, 7 Drawing Figures

CARD FEEDING APPARATUS FOR AN AUTOMATIC EMBOSSING SYSTEM

BACKGROUND OF THE INVENTION

1. Field of the Invention

The present invention relates to an apparatus for feeding cards to the embossing apparatus of an automatic embossing system.

2. The Prior Art

Automatic embossing systems for embossing a supply of cards are known in the prior art. One such automatic embossing system is disclosed in U.S. Pat. No. 4,088,216 to LaManna, et al., assigned to the assignee of the present application.

The apparatus for feeding cards to the embossing apparatus in the LaManna, et al. patent includes an input hopper and a pair of pole-like card pickers which are driven to push a single card from a stack of cards in the input hopper in order to position the card so that it can be withdrawn by a card carriage which then carries the card through the embossing apparatus. The card pickers are driven by a linkage mechanism which is in turn driven by an eccentric. While the card pickers, linkage mechanism and eccentric of the card feeding apparatus of the LaManna et al patent provide satisfactory operation, they do have certain disadvantages. The complex linkage mechanism has a large number of parts which require adjustment so that the card pickers will operate properly, and which increase the chances that a part may fail. In addition, while the eccentric and linkage mechanism provide sufficient force for picking a single plastic card from a stack of cards, new embossing applications include metal plates and tags, requiring greater driving force than normally required for picking plastic cards, for which the mechanism of the U.S. Pat. No. 4,088,216 was designed. This is because metal cards may have burrs on their edges (a result of the manufacturing process) which sometimes catch on adjacent cards in the card stack, requiring greater force for picking a metal card from a stack, than for plastic cards. Prior art pole-like card pickers thus may be unsuitable for such new, metal card applications.

SUMMARY OF THE INVENTION

Accordingly, an object of the present invention is to provide a card feeding apparatus for an automatic embossing system, which is simpler than prior art apparatus and which provides a picking force sufficient to assure that a metal card is successfully picked from a stack of metal cards.

Another object of the invention is to provide a card feeding apparatus which is simple in construction, having fewer moving parts than prior art card feeding apparatus.

The card feeding apparatus of the present invention includes a card picking mechanism comprising a card shelf for picking one card at a time from a stack of cards, a carriage on which the card shelf is mounted, a rocker arm for raising the carriage, a cam having a shoulder screw for driving the rocker arm and a motor for rotating the cam.

The card feeding apparatus of the present invention also includes an adjustable input hopper for receiving the stack of cards, wherein the hopper may be adjusted to accommodate cards of differing height, width and thickness dimensions.

The card feeding apparatus of the present invention is simpler and provides a higher card picking force than prior art apparatus. Thus, the card feeding apparatus of the present invention can be used to feed cards made of various materials (e.g. plastic and metal) and is more reliable than prior art apparatus.

These together with other objects and advantages, which will become subsequently apparent, reside in the details of construction and operation as are more fully hereinafter described and claimed, reference being had to the accompanying drawings forming a part hereof, wherein like numerals refer to like parts throughout.

DETAILED DESCRIPTION OF THE PREFERRED EMBODIMENT

Figure 1:
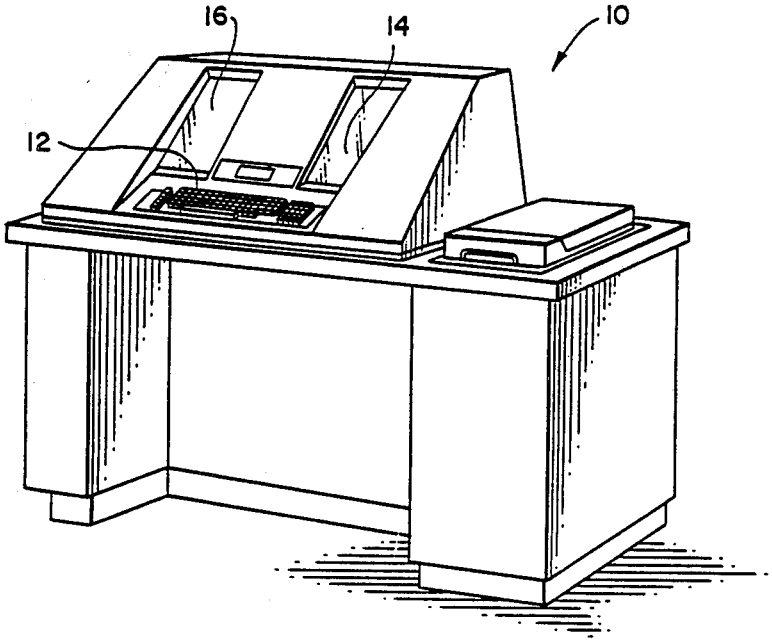
FIG. 1 is a perspective view of an automatic embossing system, similar to that disclosed in U.S. Pat. No. 4,088,216, in which the card feeding apparatus of the present invention may be employed.

FIG. 1 is a perspective view of an automatic embossing system 10 in which the card feeding apparatus of the present invention may be employed. The embossing system 10 is similar to that of U.S. Pat. No. 4,088,216, the disclosure of which is hereby incorporated by reference. The system 10 includes a keyboard 12 for controlling the operation of the system, an input hopper 14 for receiving cards to be fed to an embossing apparatus and an output hopper 16 for receiving and stacking embossed cards.

Figure 4:
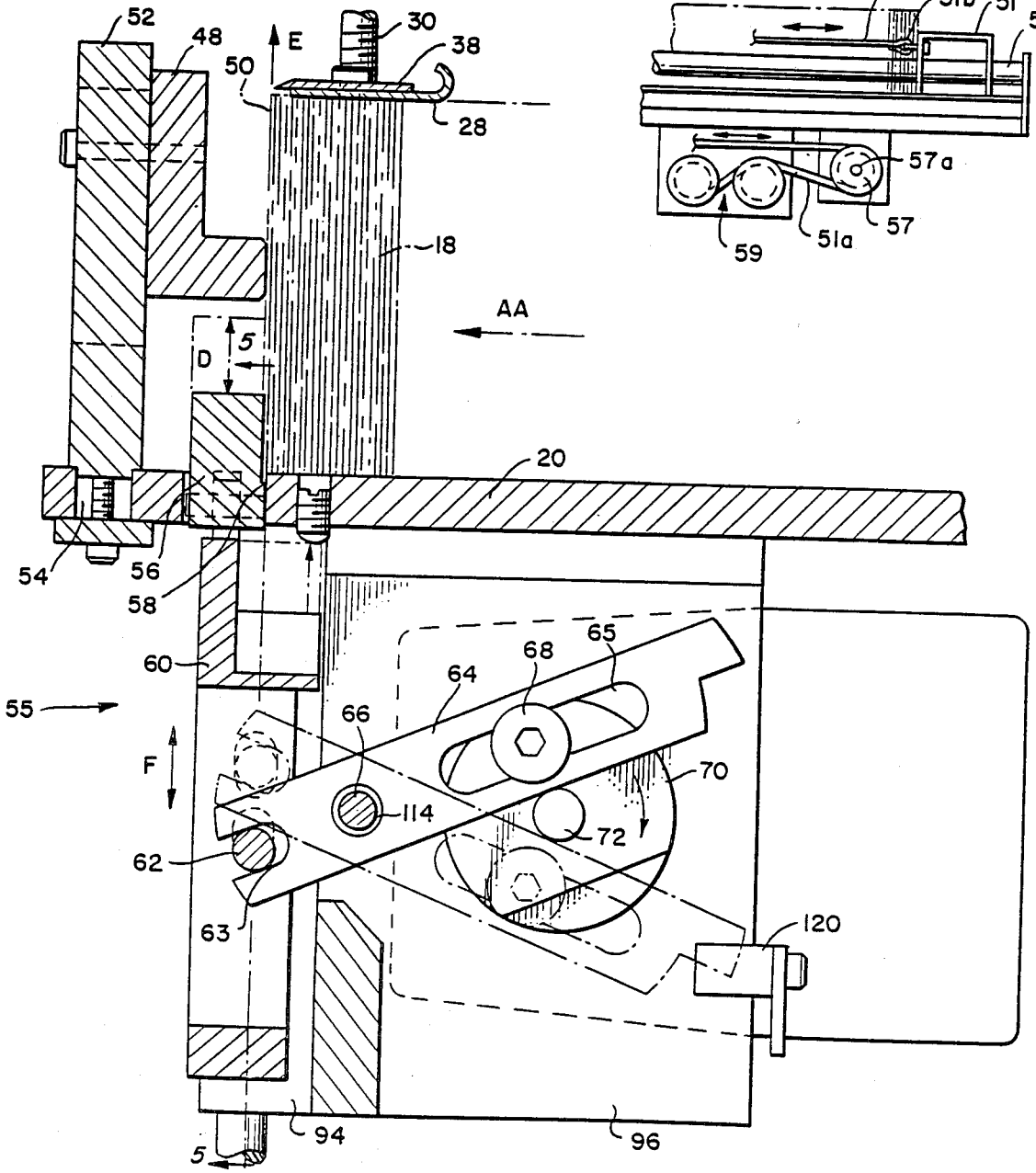
FIG. 4 is a cross-sectional view of the input hopper, and the card picking mechanism, taken along lines 4—4 of FIG. 2.

FIG. 4 is a cross-sectional view of a card picking mechanism 55, which together with the input hopper 14 forms the card feeding apparatus of the present invention.

Figure 2:
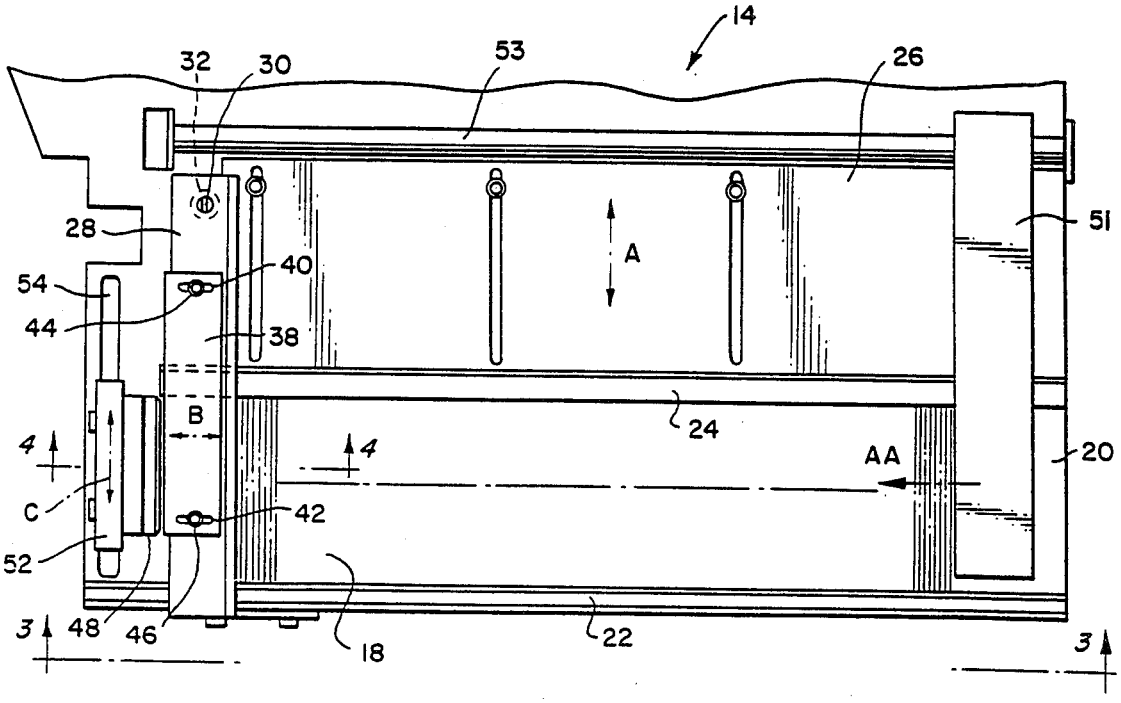
FIG. 2 is a top plan view of the input hopper portion of the card feeding apparatus of the present invention.

FIG. 2 is a top plan view of the input hopper 14, having a support plate 20, for receiving a stack of cards 18 to be individually picked and fed to the embossing apparatus of the automatic embossing system 10. In the preferred embodiment, the cards are edge-stacked on their longer edge dimension in a vertically up-right position on the support plate 20. Other orientations may be employed, however.

The input hopper 14 is adjustable to receive card stacks of varying heights, widths and thicknesses. One side of the card stack 18 is positioned against a guard rail 22 while the other side of the card stack 18 is engaged by an edge guide 24 mounted on a plate 26 which is slideably mounted on hopper plate 20. The plate 26 (and hence the edge guide is movable in the directions illustrated by double arrow A in FIG. 2 so as to cause the edge guide 24 to contact the edge of the card stack 18 opposite the guide rail 22; the input hopper 14 thereby is adjusted to receive the desired width card.

The mechanism for adjusting the input hopper 14 for the card height includes a hopper bracket 28, a screw 30 and a thumb nut 32. The hopper bracket 28 has a pair of elongated slots 28*a* (FIG. 3) through which a pair of bolts 34 and 36 are fastened to hopper plate 20. The hopper bracket 28 is slideable along the length of slots 28*a* and is positioned for the appropriate height of the cards. When the hopper bracket 28 is positioned at the desired height, the thumb screw 32 is threaded to hold the hopper bracket 28 in place.

An L-shaped card backup, or abutment block 48 is positioned so as to abut and thereby steady a first card 50 of the stack (FIGS. 3A and 4) which is to be fed to the embossing apparatus. The card backup block 48 is mounted on an adjusting block 52 which is slideably mounted on the hopper plate 20 through a slot 54 in the hopper plate 20. The adjusting block 52 is slideable in the directions indicated by the double headed arrow C in FIG. 2 so as to position the card backup block 48 to engage the middle of the card 50 which is to be fed to the embossing apparatus.

A card stripper 38 is adjustably mounted on the hopper bracket 28 so that its position may be varied in accordance with card thickness, to define a feed throat, or opening, relative to the abutment block 48, to permit a single card to pass vertically therebetween. The card stripper 38 has slots 40 and 42 through which bolts 44 and 46 are fastened to the hopper bracket 28 (FIG. 3). The card stripper 38 is slideable along the slots 28*a* in the directions indicated by double headed arrow B in FIG. 2 to adjust its location in accordance with card thickness and is then secured in the desired position by the bolts 34 and 36.

Figure 3A:
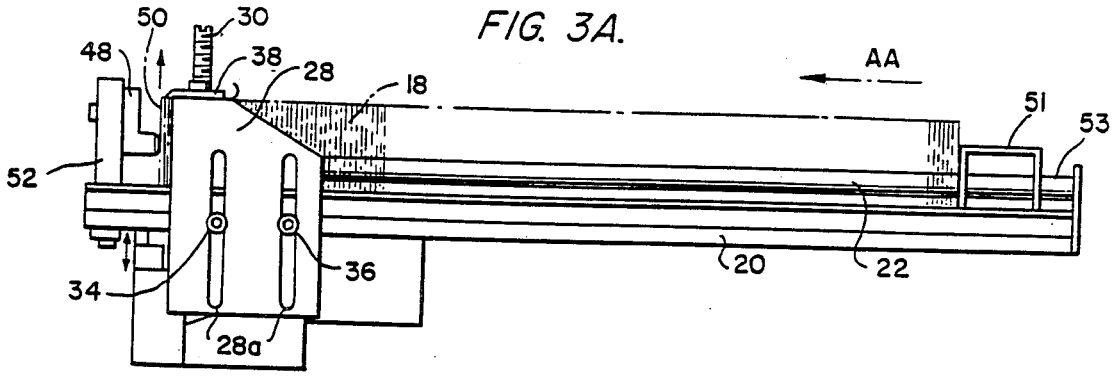
FIG. 3A is a side view of the input hopper taken along lines 3—3 of FIG. 2.
Figure 3B:
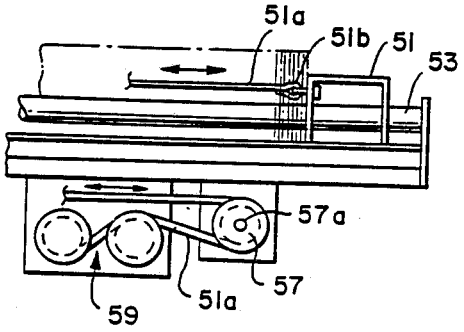
FIG. 3B is a partial view of a portion of the apparatus shown in FIG. 3A, for illustrating a biasing mechanism for the card stack.

The input hopper 14 also includes a compression arm 51 which travels on rail 53, the latter secured to plate 20, for compressing the card stack 18 in the direction indicated by arrow AA in FIGS. 2, 3A and 4 and causing the first card of the stack to engage the abutment block 48. As illustrated in detail in FIG. 3B, the urging mechanism preferably is implemented by a cable 51*a* having a loop 51*b* which is fastened to the compression arm 51, an idler pulley (not shown), a pulley 47, and a constant force spring unit 59. The cable 51*a* travels around the idler pulley, is wrapped about the pulley 57 several times, and is then inserted into constant force spring unit 59. The pulley 57 is rotated by a shaft 57*a* which is driven by a motor (not shown) and feeds the end of cable 51*a* to the constant force spring unit 59. The motor maintains a constant driving torque on the pulley 57 to urge the arm 51 and thus the cards 18 in the direction AA, as discussed above. When loading the card stack 18 into the input hopper 14 the compression arm 51 is moved in the direction opposite arrow AA in FIG. 3A and the constant force spring unit 59 plays out the cable 51*a* until the compression arm 51 is in the desired position.

Referring to FIG. 4, the card picking mechanism 55 includes a card shelf 56 having a ledge 58 for firmly engaging the bottom edge of the card 50 which is to be fed to a card transport mechanism. The elongated ledge 58 is of a length equal to a maximum card width and a depth less than a minimum card thickness. The card shelf 56 is mounted on a carriage 60 having a shaft 62 received in a forked portion 63 of a rocker arm 64. A shoulder screw 68 is fastened through a slot 65 in the rocker arm 64 to a cam 70 for movement with the cam 70. The shoulder screw 68 is slideable in the slot 65, thereby oscillating the rocker arm 64 which in turn drives the shaft 62 in vertical reciprocating motion by sliding engagement in the fork 63.

Figure 5:
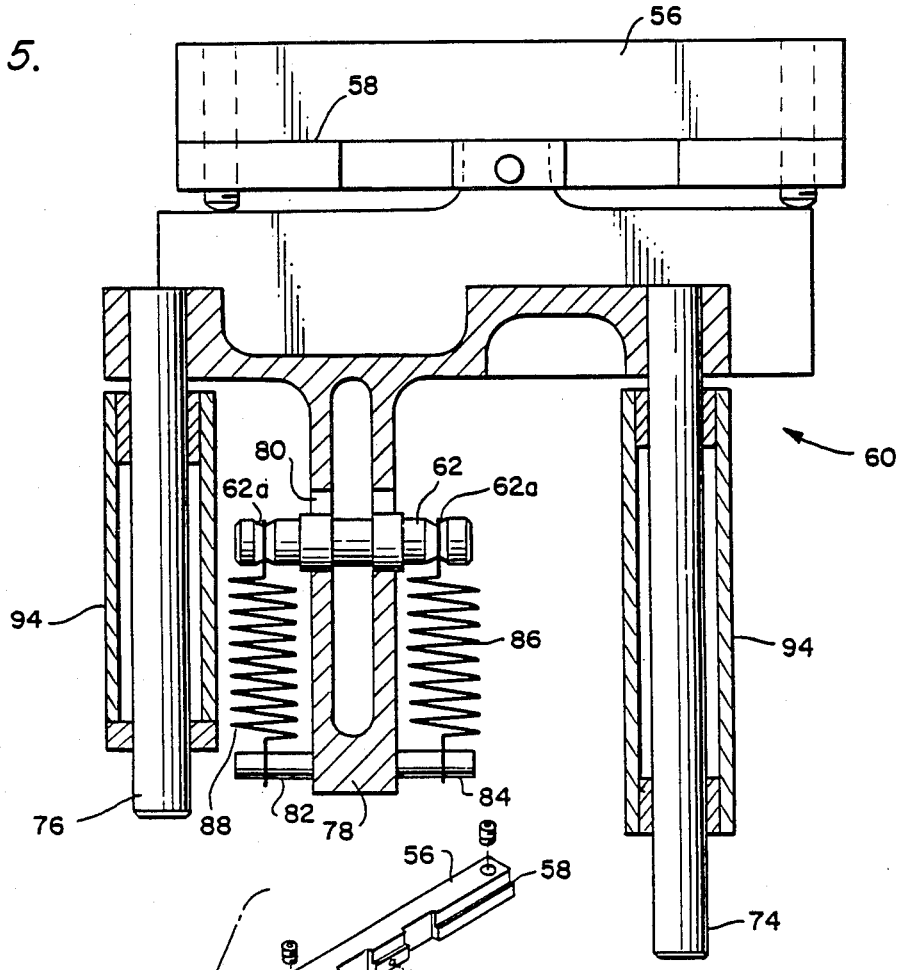
FIG. 5 is a cross-sectional view taken along lines 5—5 of FIG. 4.
Figure 6:
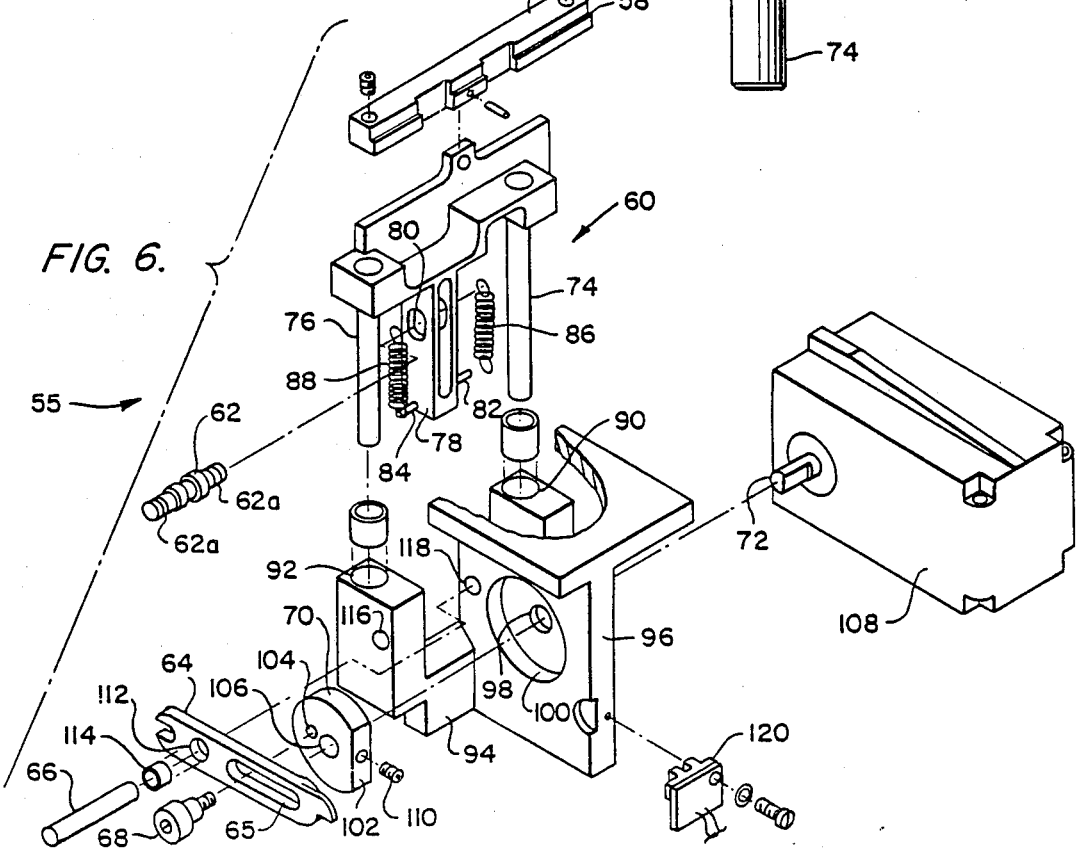
FIG. 6 is an exploded view of the card picking mechanism of the present invention.

The components of the card picking mechanism 55 are best illustrated by the exploded view shown in FIG. 6. In FIG. 6, the card shelf 56 is secured to the carriage 60. The carriage 60 includes legs 74 and 76 and a central drive column 78 having an aperture 80 and having a pair of pegs 82 and 84 mounted thereon. The legs 74 and 76 are slideably mounted in complementary holes 90 and 92, respectively, in a U-shaped mounting block 94. The shaft 62 is received in the aperture 80 and has end grooves 62*a* for receiving and retaining loop ends of bias springs 86 and 88 thereon. The other ends of springs 86 and 88 are connected to pegs 82 and 84, respectively. The springs 86 and 88 resiliently engage the shaft 62 at the bottom of apertures 80 (FIG. 5). As discussed in more detail hereafter, the rocker arm 64 slidingly engages shaft 62 at its forked end 63, and thus drives the carriage 60 in vertical, reciprocating movement in a vertical plane as defined by legs 74 and 76. Springs 86 and 88 afford a yielding drive connection, in the event movement of the carriage is obstructed.

A cam mounting block 96, having an aperture 98 and a cam-receiving indent portion 100, extends from the bottom portion of U-shaped mounting block 94. The cam 70 is shaped to fit within the indent portion 100 and has a flattened portion 102, a threaded hole 104 for receiving the shoulder screw 68, and an aperture 106 by which the cam 70 is mounted on the motor shaft 72 of motor 108. Thus, cam 70 is positioned within the indent portion 100, and the motor shaft 72 extends through the aperture 98 in block 96 and the aperture 106 in cam 70. The cam 70 is secured to motor shaft 72 by, for example, a set screw 110.

The shoulder screw 68 extends through slot 65 in the rocker arm 64 and is threaded into the hole 104 in cam 70. Rocker arm 64 has an aperture 112 for receiving a bearing 114 and the shaft 66 which is secured at its ends in holes 116 and 118 in the mounting block 94 and the cam mounting block 96, respectively. It will be understood that the rocker arm 64, in assembled position, is located adjacent to the block 96 for pivotal movement in a plane perpendicular to the axis of rotation of cam 70 and thus of motor shaft 72, and is aligned with the drive column 78 to be received within the vertical slot therein with its forked end 63 received over and slidingly engaging the reduced diameter, central portion of shaft 62. A photodetector 120 is secured to the cam mounting block 96 and is employed to detect the position of the rocker arm 64.

In operation, the input hopper 14 is adjusted for the particular card height, width and thickness. Thus, edge guide 24 and plate 26 are adjusted so that the edge guide will abut one edge of the card stack 18 and will align the other edge of card stack 18 against guide rail 22. Next, the position of the hopper bracket 28 is adjusted by varying the position of thumb nut 32 so that the top portion of hopper bracket 28 is fixed on the upper edge of card stack 18. The adjusting block 52 and card backup block 48 then are positioned so that the card backup block 48 engages the middle of the first card 50 in card stack 18, permitting it to extend beyond the front edge of plate 20. Finally, the position of card stripper 38 is adjusted so that the horizontal space between the edge of card stripper 38 and the card backup block defines one card thickness.

Once the input hopper dimensions have been adjusted for the particular size cards to be embossed, the card feeding operation may then begin. Referring to FIGS. 4 and 6, in the feeding operation, the motor 108 rotates the motor shaft 72 which in turn rotates the cam 70. As the cam 70 rotates, the shoulder screw 68 rides in the slot 65 in the rocker arm 64 and pivots the rocker arm 64 about the shaft 66. As the rocker arm 64 oscillates, the forked portion 63 of the rocker arm 64 engages the shaft 62 and reciprocates the shaft in the directions indicated by double headed arrow F in FIG. 4. The rocker arm 64 (as well as the card shelf 56) is in a card feeding position when it is in the position shown by the dotted lines in FIG. 4. Thus, the shaft 62 and the carriage 60 are moved in the direction shown by the upward direction of double-headed arrow F as seen in FIG. 4. The card shelf 56 is raised by the carriage 60 to the card feeding position as shown by the upward direction of double arrow D as seen in FIG. 4. As the card shelf 56 is raised to a card feeding position, the ledge portion 58 of card shelf 56 picks up the card 50 and raises it relatively to the card stack 18 in the direction shown by arrow E in FIG. 4 so that the card 50 may be engaged by a card carriage (not shown) which will feed the card 50 through the embossing apparatus. The type of card carriage which may be employed is disclosed in U.S. Pat. No. 4,088,216. As noted above, the card stripper 38 has been previously positioned so that only one card 50 at a time will be fed to the card carriage. When the card 50, which has been raised by the card shelf 56, reaches the card feeding position, the card carriage then grasps the card 50 and transports the card 50 to the card embossing apparatus. The card shelf 56, through the rotation of the cam 70 and the shoulder screw 68, will then fall to a lowered, card receiving position as shown by the solid lines in FIG. 4. When a first card 50 is withdrawn from the card feeding apparatus by the card carriage, the constant pressure of the compression arm 51 causes the next successive card 50 in the stack 18 to be pushed forward against the card backup block 48. This successive card 50 will then be in a position to be raised, or picked, by the ledge 58 of the card shelf 56 during the next revolution of the cam 70. The photodetector 120 detects the rocker arm 64 when the card shelf 56 is in its raised card feeding position and generates a detection signal.

The cam and rocker arm feeding arrangement is such that for about 300° of rotation of the motor 108, the card shelf 56 is raised to the card feeding position. The shelf 56 then returns to and remains at the rest position for the remaining 60° of rotation of the motor. This arrangement is particularly suitable for embossing systems which are used to emboss metal tags or cards because the card picking mechanism described above can readily provide up to 40 pounds of force for thrusting a card into a card feeding position, thereby insuring that any opposition to feed or picking, caused by burrs or other deformities will be overcome by the increased card picking force and the card 50 will not stick to the adjacent card in the card stack 18.

The many features and advantages of the invention are apparent from the detailed specification and thus it is intended by the appended claims to cover all such features and advantages of the system which fall within the true spirit and scope of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed is:

1. Apparatus for receiving a stack of cards to be embossed and for individually feeding cards to an embossing apparatus in an automatic embossing system, the stack of cards having a top, a bottom, first and second ends and first and second sides, said apparatus comprising:

an input hopper for receiving the stack of cards to be embossed, said input hopper comprising:

a hopper plate engaging the bottom of the card stack;

a guide rail mounted on said hopper plate and engaging the first side of the card stack;

an edge guide adjustably mounted on the hopper plate and engaging the second side of the card stack;

a hopper bracket adjustably mounted on said hopper plate and engaging the top of the card stack;

a backup block adjustably mounted to said hopper plate and engaging the first card of the card stack; and a card stripper adjustably mounted to said hopper bracket and positioned adjacent the first end of the card stack so that the horizontal distance between said card stripper and said backup block is defined by one card thickness;

a shaft selectively driven in rotation;

a cam mounted on said shaft for rotation thereby;

a driver extending from said cam parallel to and displaced from said shaft;

a rocker arm mounted for pivotal movement about a pivot axis parallel to said shaft, said rocker arm having first and second ends and having a slot, adjacent said second end, through which said driver extends in sliding engagement, said pivot axis being positioned intermediate said first end and said slot, said rocker arm being oscillated about the pivot axis by the sliding motion of said driver in the slot during rotation of said cam; and shelf means, positioned for sliding movement adjacent said input hopper and slidingly connected to said first end of said rocker arm, for raising an individual first card of the card stack from a rest position in said input hopper to a card feeding position in response to the oscillating motion of said rocker arm.

2. Apparatus as set forth in claim 1, wherein said first end of said rocker arm has a forked end portion and wherein said shelf means comprises:

a carriage having a rocker shaft seated in the forked end of said rocker arm;

a card shelf mounted on said carriage, said card shelf having a card ledge for supporting a first of the stack of cards to be fed to said card feeding position, wherein said carriage, said card shelf and the card carried on the card ledge of said card shelf are raised to said card feeding position as said rocker arm oscillates said rocker shaft.

3. Apparatus as set forth in claim 1, wherein said driver comprises a shoulder screw.

4. Apparatus for receiving a stack of cards to be embossed and for individually feeding cards to an embossing apparatus of an automatic embossing system, comprising:

an input hopper for receiving the stack of cards to be embossed, the stack of cards having a top, a bottom, first and second sides, and first and second ends, said input hopper comprising:

a hopper plate engaging the bottom of the card stack;

a guide rail mounted on the hopper plate and engaging the first side of the card stack;

an edge guide adjustably mounted on said hopper plate and engaging the second side of the card stack;

a hopper bracket adjustably mounted to said hopper plate and engaging the top of the card stack;

a backup block adjustably mounted to the hopper plate and positioned against the first end of the card stack;

a card stripper adjustably mounted to the hopper bracket and positioned adjacent the first end of the card stack so that the horizontal distance between said card stripper and said backup block is defined by one card thickness; and card picking means, positioned adjacent the first end of the card stack, for raising the card which is at the first end of the card stack to a card feeding position.

5. Apparatus as set forth in claim 4, wherein said input hopper further comprises:

compression means for applying pressure to the second end of the card stack wherein the cards in the card stack are compressed toward said backup block.

6. Apparatus for receiving a stack of cards to be embossed and for individually feeding cards to an embossing apparatus in an automatic embossing system, comprising:

an input hopper for receiving a stack of cards to be embossed;

a shaft selectively driven in rotation;

a cam mounted on said shaft for rotation thereby;

a driver extending from said cam parallel to and displaced from said shaft;

a rocker arm mounted for pivotal movement about a pivot axis parallel to said shaft, said rocker arm having a forked end and having a slot through which said driver extends in sliding engagement, said rocker arm being oscillated about the pivot axis by the sliding motion of said driver in the slot during rotation of said cam;

a carriage having a rocker shaft seated in the forked end of said rocker arm; and a card shelf mounted on said carriage and positioned for sliding movement adjacent said input hopper, said card shelf having a card ledge for raising an individual first card of the stack of cards from a rest position in said input hopper to a card feeding position in response to the oscillating motion of said rocker arm, said card shelf and the card carried on the card ledge on said card shelf being raised to said card feeding position as said rocker arm oscillates said rocker shaft.

7. Apparatus as set forth in claim 6, wherein the card stack has a top, a bottom, first and second ends and first and second sides and wherein said input hopper comprises:

a hopper plate engaging the bottom of the card stack;

a guide rail mounted on said hopper plate and engaging the first side of the card stack;

an edge guide adjustably mounted on the hopper plate and engaging the second side of the card stack;

a hopper bracket adjustably mounted on said hopper plate and engaging the top of the card stack;

a backup block adjustably mounted to said hopper plate and engaging the first card of the card stack; and a card stripper adjustably mounted to said hopper bracket and positioned adjacent the first end of the card stack so that the horizontal distance between said card stripper and said backup block is defined by one card thickness.

8. Apparatus for receiving a stack of cards to be embossed and for individually feeding cards to an embossing apparatus of an automatic embossing system, comprising:

an input hopper for receiving the stack of cards to be embossed, the stack of cards having a top and having first and second ends, said input hopper comprising:

a backup block positioned against the first end of the card stack;

a card stripper positioned above the top of the card stack adjacent the first end of the card stack, the horizontal distance between said card stripper and said backup block being defined by one card thickness; and compression means for applying pressure to the second end of the card stack to compress the cards in the card stack towards said backup block; and card picking means, positioned adjacent the first end of the stack, for raising the card which is at the first end of the card stack to a card feeding position.

9. Apparatus as set forth in claim 8, wherein said compression means comprises:

a compression arm positioned against the second end of the card stack;

a cable having a first end secured to said compression arm and having a second end;

a constant force spring unit to which the second end of said cable is secured;

an idler pulley having said cable wrapped around it; and means for rotating said idler pulley to maintain a constant driving torque on said idler pulley, thereby urging said compression arm against the second end of the card stack.

10. Apparatus for receiving a stack of cards to be embossed and for individually feeding cards to an embossing apparatus in an automatic embossing system, comprising:

an input hopper for receiving the stack of cards to be embossed;

a shaft selectively driven in rotation;

a cam mounted on said shaft for rotation thereby;

a driver extending from said cam parallel to and displaced from said shaft;

a rocker arm mounted for pivotal movement about a pivot axis parallel to said shaft, said rocker arm having a first end including a forked end portion, having a second end and having a slot, adjacent said second end, through which said driver extends in sliding engagement, said pivot axis being positioned intermediate said first end and said slot, said rocker arm being oscillated about the pivot axis by the sliding motion of said driver in the slot during rotation of said cam; and shelf means, positioned for sliding movement adjacent said input hopper and slidingly connected to said first end of said rocker arm, for raising an individual first card of the card stack from a rest position in said input hopper to a card feeding position in response to the oscillating motion of said rocker arm, said shelf means comprising:

a carriage having a rocker shaft seated in the forked end of said rocker arm; and a card shelf mounted on said carriage, said card shelf having a card ledge for supporting a first of the stack of cards to be fed to said card feeding position, said carriage, said card shelf and the card carried on the card ledge of said card shelf being raised to said card feeding position as said rocker arm oscillates said rocker shaft.

* * * * *